US005487249A

United States Patent [19]

Shaw et al.

[11] Patent Number: 5,487,249

[45] Date of Patent: Jan. 30, 1996

[54] DOWEL PLACEMENT APPARATUS FOR MONOLITHIC CONCRETE POUR AND METHOD OF USE

[76] Inventors: Ronald D. Shaw, 1988 Pelican, Costa Mesa, Calif. 92626; Lee A. Shaw, 1924 Irvine Ave., Newport Beach, Calif. 92660

[21] Appl. No.: 219,137

[22] Filed: Mar. 28, 1994

[51] Int. Cl.[6] ..... E04B 1/62

[52] U.S. Cl. ..... 52/396.02; 52/704; 52/699; 404/60

[58] Field of Search ..... 52/223.13, 396.02, 52/699, 677, 704, 701, 700; 404/47, 59, 60, 61

[56] References Cited

U.S. PATENT DOCUMENTS

| | | | |
|---|---|---|---|
| 1,045,562 | 11/1912 | Kennedy . | |
| 1,728,936 | 8/1926 | Johnson . | |
| 2,095,060 | 10/1937 | Geyer | 404/60 |
| 2,275,272 | 12/1938 | Scripture | 25/154 |
| 2,277,203 | 12/1938 | Boult | 94/24 |
| 2,296,453 | 4/1941 | Saffert | 25/155 |
| 2,365,550 | 12/1944 | Heltzel | 404/62 |
| 2,508,443 | 5/1950 | Carter | 404/60 |
| 2,636,426 | 9/1946 | Heltzel | 94/51 |
| 2,746,365 | 11/1951 | Darneille | 94/33 |
| 3,896,599 | 7/1975 | Werstein et al. | 52/704 |
| 4,115,976 | 9/1978 | Rohrer | 52/741 |
| 4,146,599 | 3/1979 | Lanzetta | 264/35 |
| 4,261,496 | 4/1981 | Mareydt et al. | 224/315 |
| 4,496,504 | 1/1985 | Steebsib et al. | 264/69 |
| 4,533,112 | 8/1985 | Santos, Jr. et al. | 249/3 |
| 4,578,916 | 4/1986 | Witschi | 52/396 |
| 4,648,739 | 3/1987 | Thomsen | 404/60 X |
| 4,748,788 | 6/1988 | Shaw et al. | 52/742 |
| 4,752,153 | 6/1988 | Miller | 52/396.02 X |
| 4,800,702 | 1/1989 | Wheeler | 52/677 |
| 4,938,631 | 7/1990 | Maechtle et al. | 52/704 X |
| 4,959,940 | 10/1990 | Witschi | 52/203.13 X |
| 5,005,331 | 4/1991 | Shaw et al. | 52/396 |
| 5,134,828 | 8/1992 | Baur | 52/699 X |
| 5,216,862 | 6/1993 | Shaw et al. | 52/396 |

FOREIGN PATENT DOCUMENTS 1094449 5/1955 France .

OTHER PUBLICATIONS

A 4 page Brochure from ARDEX regarding Floor Leveling.
A 4 page advertising Brochure from Schwing America, Inc.
A 4 page advertising Brochure from Mayco Pump Corporation.
1 page advertisement from Cemen–Tech.
1 page from L.M. Scofield Co,. re Lithotex, Top Surface Retarder.
4 page Brochure by L.M. Schofield Co. re Integral Color in Concrete.
31 page Brochure by Portland Cement re Color and Texture in Concrete.
10 page article by Portland Cement re Finishing, Aggregate, etc.
3 page article by Concrete Tie re Continuous Dowel Support & Spacer.

*Primary Examiner*—Carl D. Friedman
*Assistant Examiner*—Winnie S. Yip
*Attorney, Agent, or Firm*—Stetina Brunda & Buyan

[57] ABSTRACT

A concrete dowel placement apparatus comprising a base member which is rigidly attachable to a concrete form. Connected to the base member is an elongate, tubular dowel receiving sheath which defines an interior compartment extending axially therein. The dowel receiving sheath is connected to the base member in a manner wherein a dowel rod of predetermined size is extensible into and longitudinally slidable within the interior compartment thereof.

12 Claims, 3 Drawing Sheets

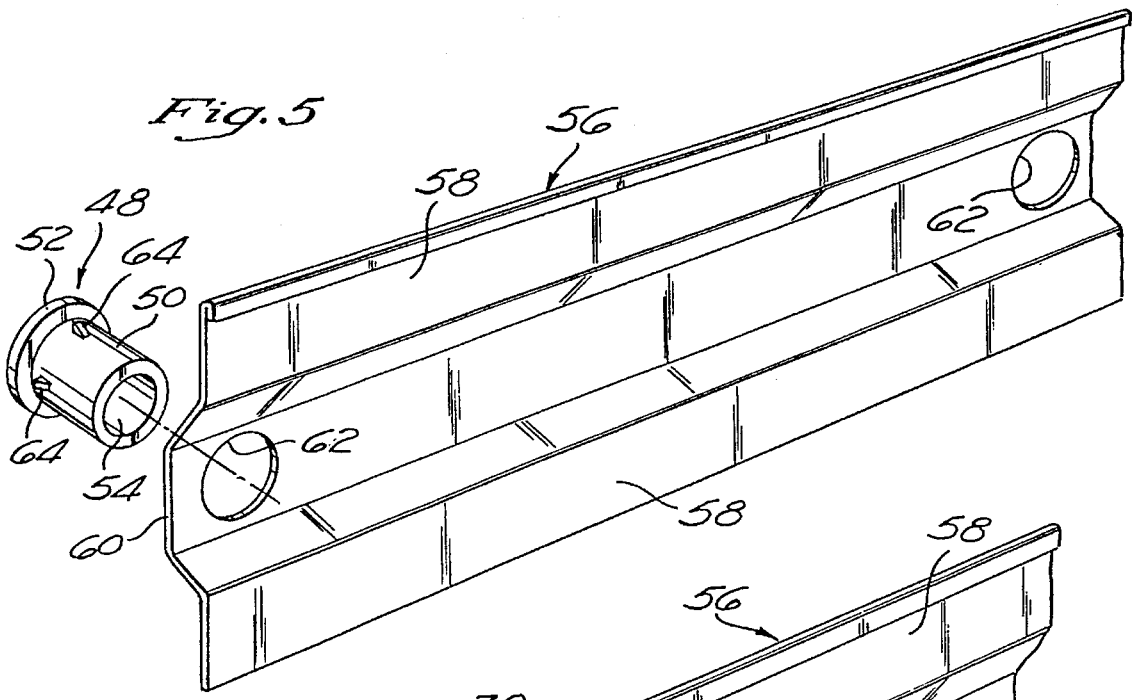
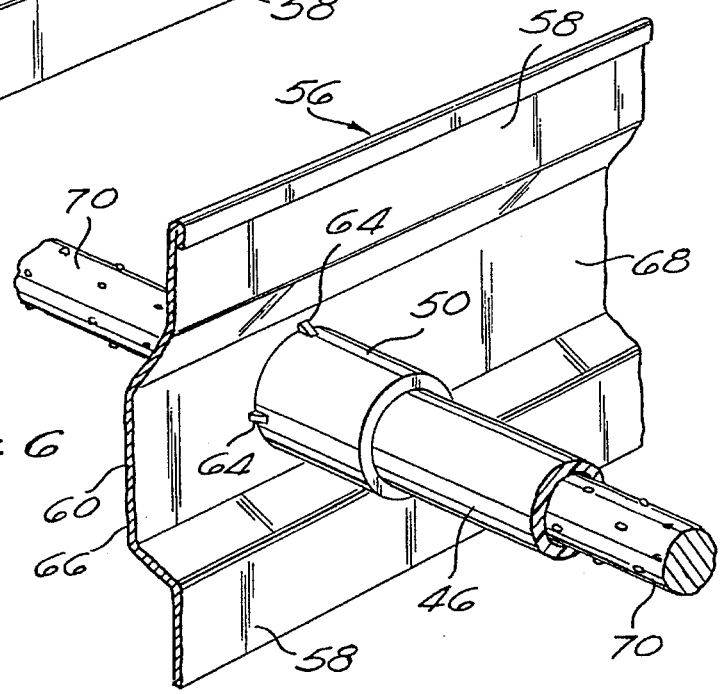
Fig. 6
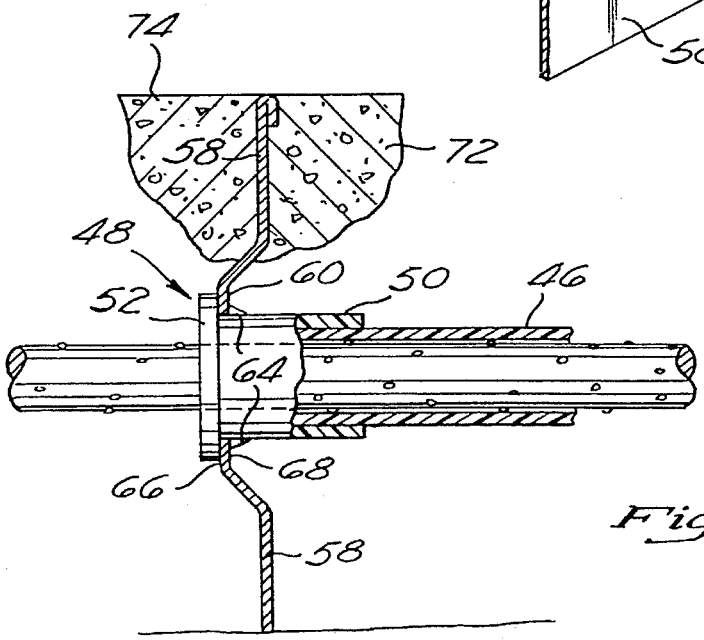
Fig. 7

DOWEL PLACEMENT APPARATUS FOR MONOLITHIC CONCRETE POUR AND METHOD OF USE

FIELD OF THE INVENTION

The present invention relates generally to the art of concrete construction, and more particularly to a device for facilitating the placement of slip dowel rods within adjacent concrete slabs of a monolithic concrete pour.

BACKGROUND OF THE INVENTION

In the art of concrete construction, it is commonplace to form "cold joints" between two or more poured concrete slabs. Such cold joints frequently become uneven or buckled due to normal thermal expansion and contraction of the concrete and/or compaction of the underlying soil caused by inadequate substrate preparation prior to the pouring of the concrete. As a means of preventing buckling or angular displacement of such cold joints, it is common practice to insert smooth steel dowel rods generally known as "slip dowels" within the edge portions of adjoining concrete slabs in such a manner that the concrete slabs may slide freely along one or more of the slip dowels, thereby permitting linear expansion and contraction of the slabs while at the same time maintaining the slabs in a common plane and thus preventing undesirable buckling or unevenness of the cold joint.

In order to function effectively, slip dowels must be accurately positioned parallel within the adjoining concrete slabs. The positioning of the dowels in a nonparallel fashion will prevent the desired slippage and will thus defeat the purpose of the slip dowel application. Additionally, the individual dowels must be placed within one or both of the slabs in such a manner as to permit continual slippage or movement of the dowel within the cured concrete slab(s).

In the prior art, two methods of installing smooth slip dowels have become popular. According to the first method, a first concrete pour is made within a pre-existing form. After the first pour has cured, an edge of the form (usually a wooden stud) is stripped away. A series of holes are then drilled parallel into the first pour along the exposed edge from which the form has been removed. The depth and diameter of the individual holes varies depending on the application and the relative size of the concrete slabs to be supported. As a general rule, however, such holes are at least twelve inches deep and typically have a diameter of approximately five-eighths (⅝) of an inch.

After the parallel series of holes has been drilled into the first pour, smooth dowel rods are advanced into each hole such that one end of each dowel rod is positioned within the first pour and the remainder of each dowel rod extends into a neighboring area where a second slab of concrete is to be poured. Thereafter, concrete is poured into such neighboring area and is permitted to set with the parallel aligned dowels extending thereinto. After the second pour has set, the slip dowels will be held firmly within the second slab, but will be permitted to slide longitudinally within the drilled holes of the first slab thereby accommodating longitudinal expansion and contraction of the two slabs while at the same time preventing buckling or angular movement therebetween.

Although the above-described "drilling method" of placing slipped dowels has become popular, it will be appreciated that such method is extremely labor intensive. In fact, it takes approximately ten minutes to drill a five-eighths (⅝) inch diameter by twelve inch long hole into the first pour and the drilling equipment, bits, accessories, and associated set up time tends to be very expensive. Moreover, the laborers who drill the holes and place the slip dowels must be adequately trained to insure that the dowels are arranged perpendicular to the joint but parallel to one another so as to permit the desired slippage during subsequent use.

The second popular method of placing slip dowels involves the use of wax-treated cardboard sleeves positioned over one end of each individual dowel. According to such method, a series of holes are drilled through one edge of the concrete form and smooth dowels are advanced through each such hole. Thereafter, treated cardboard sleeves are placed over one end of each dowel, with a first pour subsequently being made within the form which covers the ends of the dowels including the cardboard sleeves thereon. After the first pour has set, the previously drilled form is stripped away, leaving the individual dowels extending into a neighboring open space where the second pour is to be made. Subsequently, the second pour is made and permitted to cure. Thereafter, the slip dowels will be firmly held by the concrete of the second pour, but will be permitted to longitudinally slide against the inner surfaces of the wax treated cardboard sleeves within the first pour. Thus, the waxed cardboard sleeves facilitate longitudinal slippage of the dowels, while at the same time holding the two concrete slabs in a common plane, and preventing undesirable buckling or angular movement thereof.

This second method, while presently popular, is nonetheless associated with numerous deficiencies. For example, after the first pour has been made, the free ends of the dowels are likely to project as much as eighteen inches through the form and into the open space allowed for the second pour. Because the drilled section of the form must be advanced over those exposed sections of dowel to accomplish stripping or removal of the form, it is not infrequent for the exposed portions of the dowels to become bent and, thus, non-parallel. Additionally, the drilled section of the form may become damaged or broken during the removal process, thereby precluding its reuse.

Each of the above-described methods of placing slip dowels between concrete slabs often results in the dowels being finally positioned at various angles rather than in the desired parallel array. When such occurs, the necessary slippage of the dowels is impeded or prevented. Additionally, each such method necessitates that a first pour be made and permitted to set, with a second pour being made subsequent to the setting of the first pour and the removal of the form from at least one edge of the slab created by the setting of the first pour. As such, these placement methods, and in particular the "drilling method", are not suited for use in relation to monolithic or continuous concrete pours wherein the second pour occurs immediately after the first pour, with an edge of the form (e.g., a wooden stud or metal imbed form) remaining between the pours and thus the resultant concrete slabs. In many applications, continuous pours are the preferred method of concrete construction due to the reduced labor and time/cost savings associated therewith. Such savings are the result of not having to wait for the first pour to set and not having to subsequently strip an edge of the form from the first poured concrete slab. Accordingly, there is a need in the art for devices and/or methods for facilitating the proper placement of slip dowels in monolithic or continuous concrete pour applications.

SUMMARY OF THE INVENTION

In accordance with a first embodiment of the present invention, there is provided a concrete dowel placement apparatus for use in continuous pours which comprises a base member rigidly attachable to a concrete form. Connected to the base member is an elongate, tubular dowel receiving sheath which defines an interior compartment extending axially therein. The connection of the sheath to the base member is facilitated in a manner wherein a dowel rod of predetermined size is extensible into and longitudinally slidable within the interior compartment of the sheath.

The base member itself preferably comprises a tubular sleeve portion which defines an outer surface and first and second ends. Formed about the first end of the sleeve portion is a flange portion which preferably has a generally circular configuration and extends radially from the first end of the sleeve portion. The sheath preferably defines an open proximal end and a closed distal end, and is connected to the base member via the slidable receipt of the proximal end into the second end of the sleeve portion. The flange portion includes at least one aperture disposed therein which is sized to permit the passage of a fastener through the flange portion for facilitating the rigid attachment of the base member to the concrete form subsequent to the insertion of the sleeve portion into an aperture extending through the form and the abutment of the flange portion against the form. Both the base member and the sheath are preferably fabricated from plastic.

In accordance with a second embodiment of the invention, the sleeve portion of the base member includes a plurality of dimples formed on and extending about the outer surface thereof. The dimples are equidistantly spaced from the flange portion and adapted to facilitate the rigid attachment of the base member to the concrete form upon the insertion of the sleeve portion into an aperture extending through the form and the abutment of the flange portion against the form. The sleeve portion preferably includes four (4) dimples formed on the outer surface thereof in intervals of approximately ninety (90) degrees.

In accordance with a third embodiment of the present invention, the base member further comprises an annular collar member which is releasably attachable to the sleeve portion subsequent to the insertion thereof into an aperture extending through the form and the abutment of the flange portion against the form. The attachment of the collar member to the sleeve portion is adapted to maintain the base member in rigid attachment to the form. In the third embodiment, the sleeve portion preferably includes a pair of spline portions extending radially from the second end thereof in opposed relation. The collar member itself defines a central opening which is configured to facilitate the extension thereof over the second end of the sleeve portion. The rotation of the collar member subsequent to the extension thereof over the second end of the sleeve portion is operable to maintain the base member in rigid attachment to the form. The base member constructed in accordance with the first embodiment of the present invention is preferably used in conjunction with a wooden stud, with the base members constructed in accordance with the second and third embodiments of the present invention preferably being used in conjunction with a metal imbed form.

BRIEF DESCRIPTION OF THE DRAWINGS

These, as well as other features of the present invention, will become more apparent upon reference to the drawings wherein:

FIG. 5 is a perspective view of the base member of a concrete dowel placement apparatus constructed in accordance with a second embodiment of the present invention, further illustrating the metal imbed form with which the placement apparatus is preferably utilized;

FIG. 6 is a perspective view illustrating the manner with the second embodiment is attached to the metal imbed in which the placement apparatus constructed in accordance form;

FIG. 7 is a partial cross-sectional view illustrating the manner in which the placement apparatus shown in FIG. 6 is positioned between the adjacent slabs of a continuous concrete pour;

DETAILED DESCRIPTION OF THE PREFERRED EMBODIMENT

Figure 1:
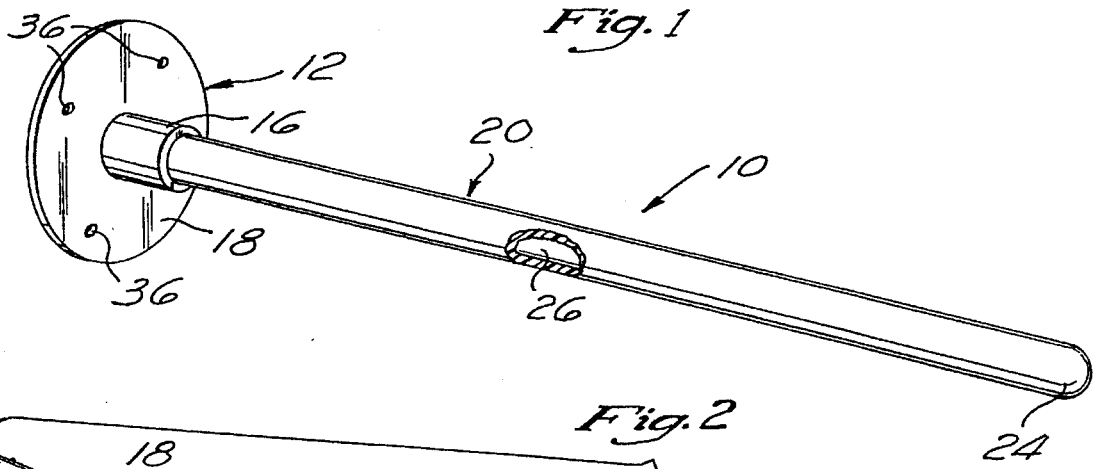
FIG. 1 is a perspective view of a concrete dowel placement apparatus constructed in accordance with a first embodiment of the present invention.
Figure 2:
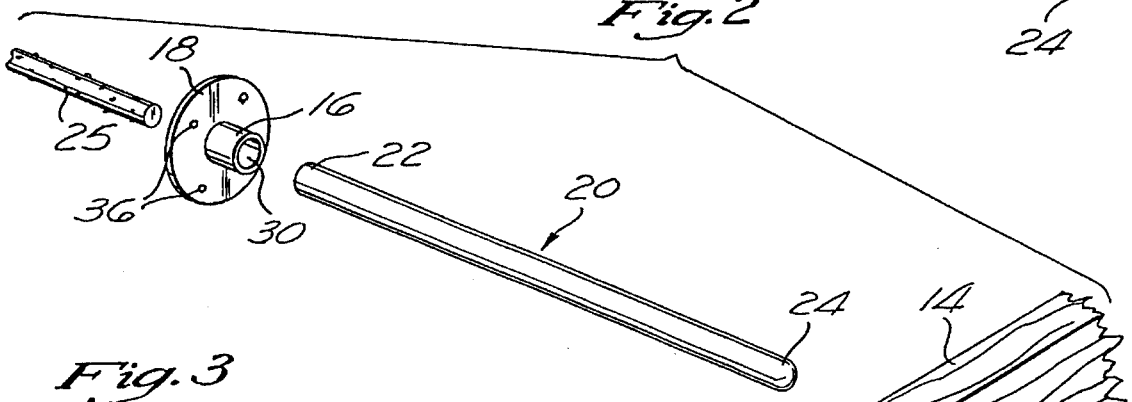
FIG. 2 is an exploded view of the placement apparatus shown in FIG. 1, further illustrating the dowel rod and concrete form with which the placement apparatus is preferably utilized.

Referring now to the drawings wherein the showings are for purposes of illustrating preferred embodiments of the present invention only, and not for purposes of limiting the same, FIG. 1 perspectively illustrates a concrete dowel placement apparatus 10 which is constructed in accordance with a first embodiment of the present invention. Referring now to FIGS. 1–4, the placement apparatus 10 is used in relation to monolithic or continuous concrete pour cold joint systems, and comprises a base member 12 which is rigidly attachable to a concrete form 14 such as a wooden stud. The base member 12 is preferably fabricated from a plastic material and itself comprises a tubular sleeve portion 16 which defines first and second opposed ends. Formed about the first end of the sleeve portion 16 is a flange portion 18 which preferably has a generally circular configuration and extends radially from the first end of the sleeve portion 16.

Figure 4:
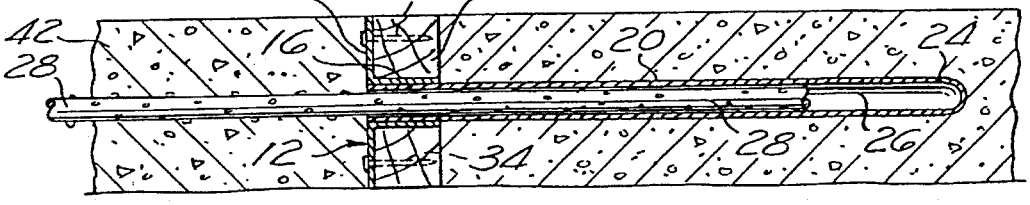
FIG. 4 is a cross-sectional view illustrating the manner in which the placement apparatus shown in FIGS. 1 and 2 and an associated dowel rod are positioned within the adjacent concrete slabs of a continuous pour.

The placement apparatus 10 further comprises an elongate, tubular dowel receiving sheath 20 which is also preferably fabricated from a plastic material and defines an open proximal end 22, a closed distal end 24, and an interior compartment 26 extending axially therein. The sheath 20 is connectable to the base member 12 in a manner wherein an elongate dowel rod 28 of predetermined size is extensible into and longitudinally slidable within the interior compartment 26 of the sheath 20. In the first embodiment, the connection of the sheath 20 to the base member 12 is facilitated via the slidable receipt of the proximal end 22 into the second end of the sleeve portion 16, and in particular the bore 30 extending axially through the sleeve portion 16. As such, the outer diameter of the sheath 20 is slightly less than the inner diameter of the sleeve portion 16 (i.e., the diameter of the bore 30) to allow the same to be slidably inserted thereinto. However, the sizing of the sheath 20 relative the bore 30 is selected so that a slight interference exists therebetween for purposes of preventing the sheath 20 from being easily removed from within the base member 12 subsequent to being inserted thereinto. As best seen in FIG. 4, the sheath 20 is preferably inserted into the bore 30 to a depth whereat the proximal end 22 thereof is substantially flush with the outer surface of the flange portion 18.

The placement apparatus 10 is utilized by initially connecting the sheath 20 to the base member 12 in the previously described manner. Thereafter, the sheath 20 is extended through an aperture 32 disposed within the form 14, with the sleeve portion 16 subsequently being inserted into the aperture 32 and the inner surface of the flange portion 18 being abutted against one of the side surfaces of the form 14. The diameter of the aperture 32 preferably slightly exceeds the outer diameter of the sleeve portion 16, thus allowing the same to be easily slidably insertable thereinto. Additionally, the length of the sleeve portion 16 is preferably equal to the depth of the aperture 32 (i.e., the thickness of the form 14) such that the second end of the sleeve portion 16 is substantially flush with one side surface of the form 14 when the inner surface of the flange portion 18 is abutted against the other side surface of the form 14.

Subsequent to the insertion of the sleeve portion into the aperture 32 in the aforementioned manner, the base member 12 is rigidly attached to the form 14. In the first embodiment, the rigid attachment is facilitated by fasteners such as nails 34 which are extended through respective ones of a plurality of apertures 36 disposed within the flange portion 18 and into the form 14. The flange portion 18 preferably includes four (4) apertures 36 disposed therein at intervals of approximately 90 degrees. As further seen in FIG. 4, the flange portion 18 is preferably sized such that the peripheral edge thereof does not extend beyond the top and bottom edges of the form when the sleeve portion 16 is inserted into the aperture 32 and the inner surface of the flange portion 18 abutted against the side surface of the form 14.

Figure 3:
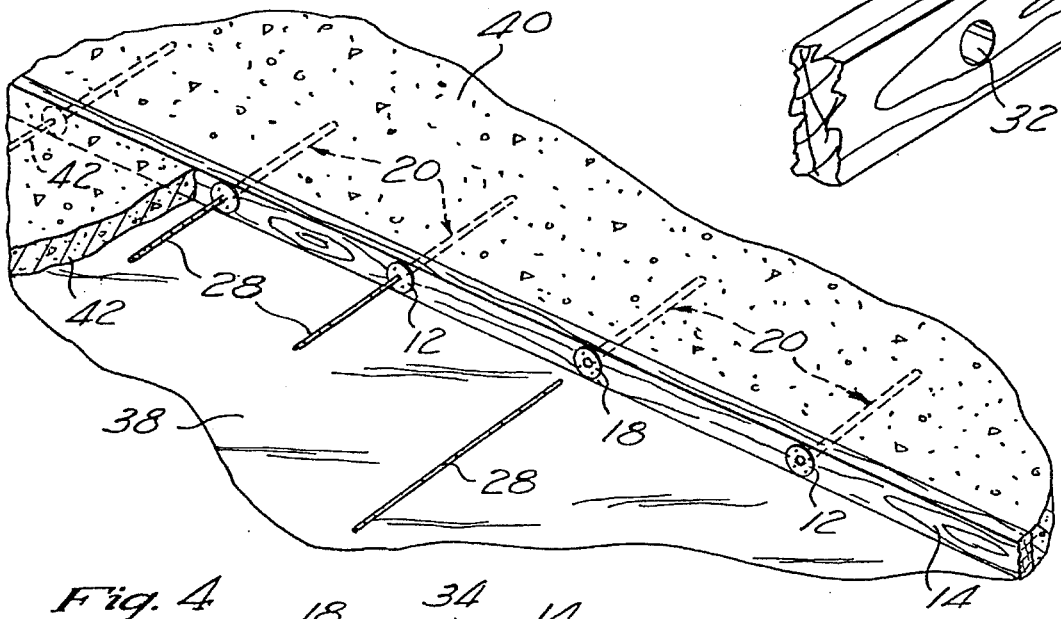
FIG. 3 is a perspective view illustrating the manner in which the placement apparatus shown in FIGS. 1 and 2 is used to properly align dowel rods between first and second adjacent concrete pours.

As seen in FIG. 3, in the continuous concrete pour cold joint system, the form 14 is provided with a plurality of linearly aligned apertures 32 which are disposed therein in equidistantly spaced intervals. Inserted into each aperture 32 is a concrete dowel placement apparatus 10 which is rigidly attached to the form 14 in the aforementioned manner. Importantly, the placement apparatuses 10 are attached to the form 14 such that the sheaths 20 thereof extend from a common side of the form 14 in substantially parallel relation. The attachment of each placement apparatus 10 (or at least each base member 12) to the form 14 typically occurs prior to the positioning of the form 14 upon the soil 38 or other substrate. After the form 14 has been properly positioned upon the soil 38, dowel rods 28 are slidably advanced into the proximal ends 22 of the sheaths 20 attached to the base members 12. Thereafter, a first pour 40 is made which encapsulates the sheaths 20, with a second pour 42 being made immediately thereafter which encapsulates the exposed portions of the dowel rods 28. Advantageously, the first and second pours 40, 42 may be made in succession via a continuous pour procedure, with the form 14 remaining between the concrete slabs formed by the setting of the first and second pours 40, 42. As will be recognized, those portions of the dowel rods 28 encapsulated by the second pour 42 will be rigidly maintained within the concrete slab formed thereby, with the portions of the dowel rods 28 disposed within the sheaths 20 being free to slide longitudinally therewithin, thereby permitting linear expansion and contraction of the slabs while maintaining the slabs in a common plane and thus preventing undesirable buckling or unevenness of the resultant cold joint.

Referring now to FIGS. 5–7, in accordance with a second embodiment of the present invention, there is provided a concrete dowel placement apparatus 44 which comprises a dowel receiving sheath 46 configured identically to the sheath 20 previously described in relation to the placement apparatus 10 and preferably fabricated from a plastic material. In addition to the sheath 46, the placement apparatus 44 comprises a base member 48 which is also preferably fabricated from a plastic material and itself comprises a tubular sleeve portion 50 defining first and second opposed ends. Formed about and extending radially from the first end of the sleeve portion 50 is a circularly configured flange portion 52. In the second embodiment, the sheath 46 is connected to the base member 48 via the slidable receipt of the proximal end thereof into the second end of the sleeve portion 50, and in particular, the bore 54 extending axially therethrough- In the placement apparatus 44, the sizing of the bore 54 relative the sheath 46 is accomplished in the same manner as previously described in relation to the bore 30 and sheath 20 of the placement apparatus 10 so that the sheath 46 is slidably insertable into the base member 48, yet not easily removable from therewithin. Additionally, the sheath 46 is preferably extended into the bore 54 to a depth whereat the proximal end thereof is substantially flush with the outer surface of the flange portion 52.

In the second embodiment, the base member 48 is adapted to be rigidly attached to a concrete form 56 which comprises a stamped metal imbed form such as that currently manufactured under the trademark "Key Kold". The form 56 defines upper and lower edge portions 58 which are separated by an offset central portion 60, having a plurality of linearly aligned apertures 62 disposed therein in equidistantly spaced intervals.

To facilitate the rigid attachment of the placement apparatus 44, and in particular the base member 48 thereof, to the form 56, formed on and extending about the outer surface of the sleeve portion 50 is a plurality of dimples 64. The dimples 64 are equidistantly spaced from the inner surface of the flange portion 52, and each have a generally wedge-shaped configuration. The attachment of the base member 48 to the form 56 is accomplished by inserting the second end of the sleeve portion 50 into a respective one of the apertures 62 and subsequently forcing the dimples 64 through the aperture 62 via the application of pressure to the flange portion 52. The passage of the dimples 64 through the aperture 62 is aided by the wedge-shaped construction thereof as well as the resiliency of the base member 48 which, as previously indicated, is preferably fabricated from a plastic material. Upon the extension of the dimples 64 through the aperture 62, the central portion 60 of the form 56 is captured between the dimples 64 and the inner surface of the flange portion 52, thus maintaining the base member 48 in rigid attachment to the form 56. The base member 48 is preferably attached to the form 56 in a manner wherein the flange portion 52 is abutted against the outer surface 66 of the central portion 60 and the dimple 64 are abutted against the inner surface 68 of the central portion 60. In the second embodiment, the sleeve portion 50 preferably includes four (4) dimples 64 formed on the outer surface thereof in intervals of approximately 90 degrees.

Typically, the sheath 46 is slidably connected to the base member 48 subsequent to its attachment to the concrete form 56 in the aforementioned manner. However, it will be recognized that the attachment of the base member 48 to the concrete form 56 may be accomplished subsequent to the connection of the sheath 46 thereto. Similar to the construction process previously described in relation to the placement apparatus 10, a plurality of placement apparatuses 44 are attached to the form 56 via the extension of the sheaths 46 and/or sleeve portions 50 thereof through the apertures 62. When the placement apparatuses 44 are properly attached to the form 56, the sheaths 46 attached to the base members 48 will extend from the inner surface 68 of the central portion 60 in substantially parallel relation. After the form 56 has been properly positioned upon the substrate, dowel rods 70 are slidably advanced into the proximal ends of respective ones of the sheaths 46. Thereafter, a first pour 72 is made which encapsulates the sheaths 46, with a second pore 74 being made immediately thereafter which encapsulates the exposed portions of the dowel rods 70. The first and second pours 72, 74 may be made in succession via a continuous pour procedure, with the metal imbed form 56 remaining between the concrete slabs formed by the setting of the first and second pours 72, 74. Those portions of the dowel rods 70 encapsulated by the second pour 74 will be rigidly maintained within the concrete slab formed thereby, with the portions of the dowel rods 70 disposed within the sheaths 46 being free to slide longitudinally therewithin, thereby permitting linear expansion and contraction of the slabs while maintaining the slabs in a common plane.

Figure 8:
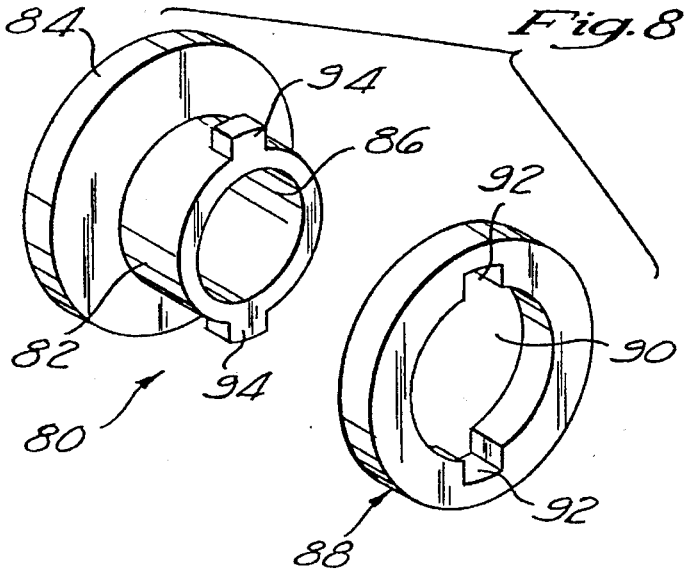
FIG. 8 is an exploded view of the base member of concrete dowel placement apparatus constructed in accordance with a third embodiment of the present invention.
Figure 9:
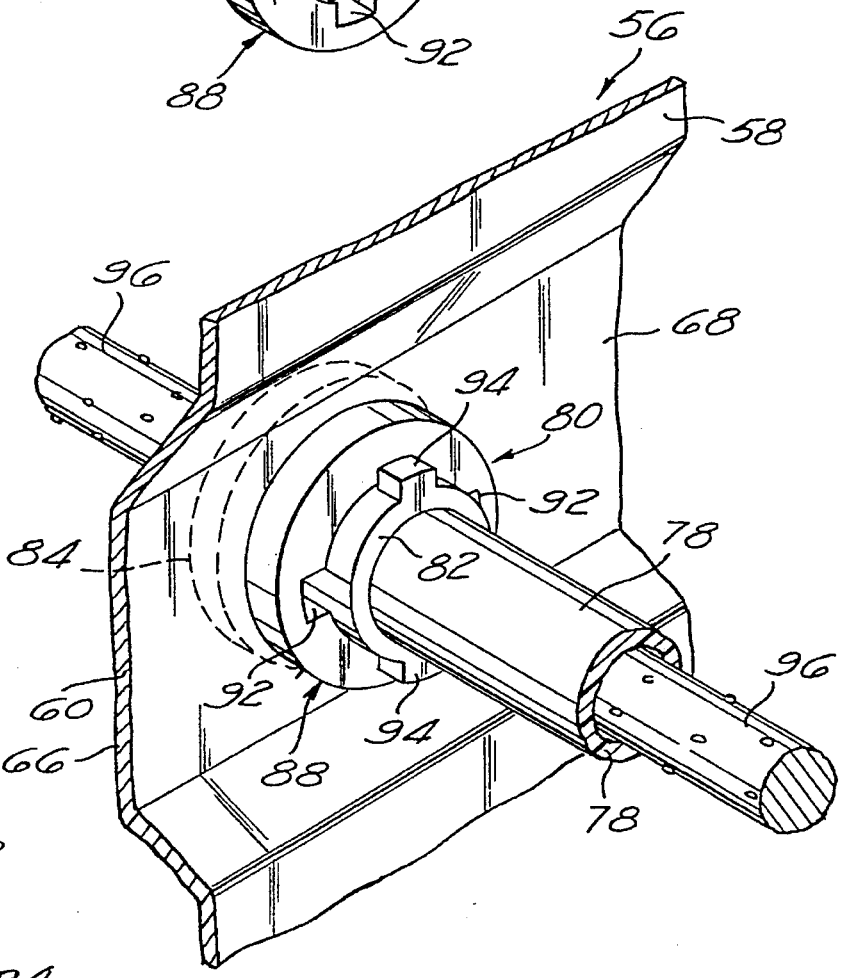
FIG. 9 is a perspective view illustrating the manner in which the placement apparatus constructed in accordance with the third embodiment is rigidly attached to a metal imbed form.
Figure 10:
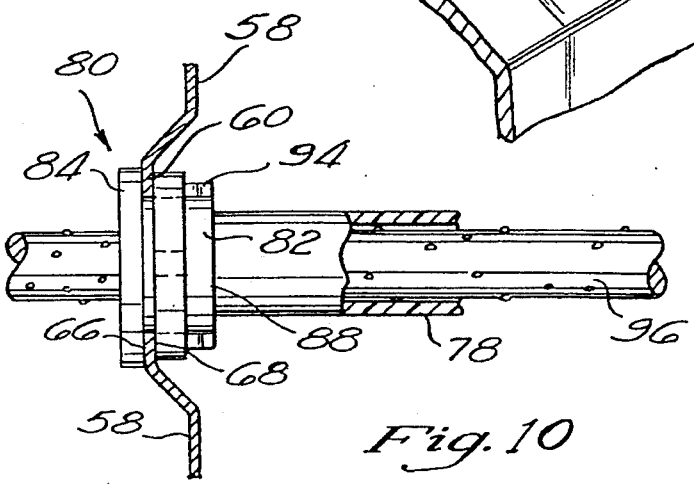
FIG. 10 is a partial cross-sectional view of the placement apparatus shown in FIG. 9.

Referring now to FIGS. 8–10, in accordance with a third embodiment of the present invention, there is provided a concrete dowel placement apparatus 76 which comprises a dowel receiving sheath 78 configured identically to the previously described sheaths 20, 46 and preferably fabricated from a plastic material. In addition to the sheath 78, the placement apparatus 76 comprises a base member 80 which is also preferably fabricated from a plastic material and itself comprises a tubular sleeve portion 82 defining first and second opposed ends. Formed about and extending radially from the first end of the sleeve portion 82 is a circularly configured flange portion 84. In the third embodiment, the sheath 78 is connected to the base member 80 via the slidable receipt of the proximal end thereof into the second end of the sleeve portion 82, and in particular, the bore 86 extending axially therethrough. As in the placement apparatuses 10, 44 previously described, the bore 86 is sized relative the sheath 78 so that the same is slidably insertable into the base member 80, yet not easily removable from therewithin. The sheath 78 is preferably extended into the bore 86 to a depth whereat the proximal end thereof is substantially flush with the outer surface of the flange portion 84.

In the third embodiment, the base member 80 is also adapted to be rigidly attached to the concrete form 56. To facilitate such rigid attachment, the base member 80 further comprises an annular collar member 88 which is preferably fabricated from a plastic material and is releasably attachable to the sleeve portion 82 subsequent to the insertion of the sleeve portion 82 into an aperture 62 of the form 56 and the abutment of the inner surface of the flange portion 84 against the outer surface 66 of the central portion 60. The collar member 88 includes a generally circular central opening 90 which defines a pair of recessed regions 92 disposed approximately 180 degrees apart from each other. The recessed regions 92 are adapted to accommodate a pair of spline portions 94 which extend radially from the second end of the sleeve portion 82 in opposed relation, thus allowing the collar member 88 to be extended over the second end of the sleeve portion 82. The diameter of the central opening 90 slightly exceeds the outer diameter of the sleeve portion 82 for purposes of allowing the collar member 88 to be rotated subsequent to the extension thereof over the second end of the sleeve portion 82 in the aforementioned manner.

After the sleeve portion 82 has been extended through an aperture 62 and the inner surface of the flange portion 84 abutted against the outer surface 66 of the central portion 60, the collar member 88 is extended over the second end of the sleeve portion 82 by aligning the spline portions 94 with the recessed regions 92 and forcing a side surface of the collar member 88 into abutting contact with the inner surface 68 of the central portion 60. Thereafter, the collar member 88 is rotated in either a clockwise or counter-clockwise direction so as to remove the recessed portions 92 and spline portions 94 from alignment with each other, which in turn facilitates the rigid attachment of the base member 80 to the form 56. As will be recognized, to permit the insertion of the sleeve portion into the aperture 62, the diameter of the aperture 62 slightly exceeds the distance separating the distal surfaces of the spline portions 94 from each other. Additionally, the width (i.e., thickness) of the collar member 88 is preferably substantially equal to the distance separating the innermost surfaces of the spline portions 94 from the inner surface 68 of the central portion 60 when the flange portion 84 is abutted against the outer surface 66, thus causing the collar member 88 to be rigidly maintained between the spline portions 94 and central portion 60 when the same is rotated.

As with the placement apparatus 44 previously described, the sheath 78 is typically connected to the base member 80 subsequent to its attachment to the concrete form 56 in the aforementioned manner, though the attachment of the base member 80 to the form 56 may be accomplished after the sheath 78 has been connected thereto. A plurality of placement apparatuses 76 are attached to the form 56 via the extension of the sheaths 78 and/or sleeve portions 82 through the aperture 62, with the collar members 88 subsequently being attached to the sleeve portions 82 in the previously described manner. When the placement apparatuses 76 are properly attached to the form 56, the sheaths 20 attached to the base members 80 extend from the inner surface 68 of the central portion 60 in substantially parallel relation. After the form 56 has been properly positioned upon the substrate, dowel rods 96 are slidably advanced into the proximal ends of the sheaths 78. Thereafter, first and second pours are made in the aforementioned manner, with the exposed portions of the dowel rods 96 being rigidly maintained within one of the concrete slabs and the portions of the dowel rods 96 disposed within the sheaths 78 being free to slide longitudinally therewithin.

Additional modifications and improvements of the present invention may also be apparent to those skilled in the art. Thus, the particular combination of parts described and illustrated herein is intended to represent only certain embodiments of the present invention, and is not intended to serve as limitations of alternative devices within the spirit and scope of the invention.

What is claimed is:

1. A concrete dowel placement apparatus attached to a concrete form which has an aperture therethrough, comprising:

a base member rigidly attachable to the concrete form, said base member comprising:

(a) an elongate, tubular sleeve portion for insertion through the aperture of the concrete form having opposed first and second ends, an outer surface and an inner surface defining a bore extending longitudinally through the sleeve portion; and (b) a flange portion formed about and extending outwardly from the first end of the sleeve portion and being engaged to the concrete form after the insertion of said sleeve portion through the aperture of the concrete form;

an elongate, tubular dowel receiving sheath attached to said base member and defining an open proximal end, a closed distal end, and a longitudinally extending interior compartment;

the attachment of the sheath to the base member being facilitated by the slidable insertion of the sheath into the bore in a manner wherein the distal end of the sheath. protrudes from the second end of the sleeve portion and the proximal end of the sheath is substantially flush with the flange portion.

2. The apparatus of claim 1 wherein said flange portion includes at least one aperture disposed therein sized to permit the passage of a fastener through the flange portion for facilitating the rigid attachment of the base member to the concrete form subsequent to the insertion of said sleeve portion into an aperture extending through the form and the abutment of the flange portion against the form.

3. The apparatus of claim 2 wherein said flange portion includes four (4) apertures disposed therein in intervals of approximately 90 degrees.

4. The apparatus of claim 1 wherein said flange portion has a generally circular configuration and extends radially from the first end of the sleeve portion.

5. The apparatus of claim 1 wherein said sleeve portion further includes a plurality of dimples formed on and extending about the outer surface thereof, said dimples being equidistantly spaced from the flange portion and adapted to facilitate the rigid attachment of the base member to the concrete form upon the insertion of said sleeve portion into an aperture extending through the form and the abutment of the flange portion against the form.

6. The apparatus of claim 5 wherein said sleeve portion includes four dimples formed on the outer surface thereof in intervals of approximately ninety degrees.

7. The apparatus of claim 5 wherein said concrete form comprises a metal imbed form.

8. The apparatus of claim 1 wherein said base member further comprises an annular collar member releasably attachable to the sleeve portion subsequent to the insertion of the sleeve portion into an aperture extending through the form and the abutment of the flange portion against the form, the attachment of said collar member to said sleeve portion being adapted to maintain said base member in rigid attachment to the form.

9. The apparatus of claim 8 wherein said sleeve portion further includes a pair of spline portions extending radially from the second end thereof in opposed relation and said collar member defines a central opening configured to facilitate the extension of the collar member over the second end of the sleeve portion, the rotation of the collar member subsequent to the extension thereof over the second end being operable to maintain said base member in rigid attachment to said form.

10. The apparatus of claim 8 wherein said concrete form comprises a metal imbed form.

11. The apparatus of claim 1 wherein said base member and said sheath are fabricated from plastic.

12. The apparatus of claim 1 wherein said concrete form comprises a wooden stud.

* * * * *